US005771429A

United States Patent [19]

Oyama et al.

[11] Patent Number: 5,771,429

[45] Date of Patent: Jun. 23, 1998

[54] DEVELOPING DEVICE CAPABLE OF AUTOMATIC TONER CONTENT CONTROL

[75] Inventors: Hajime Oyama, Ichikawa; Seiji Oka, Yokohama; Kiyonori Tsuda; Yasushi Akiba, both of Tokyo, all of Japan

[73] Assignee: Ricoh Company, Ltd., Tokyo, Japan

[21] Appl. No.: 740,560

[22] Filed: Oct. 30, 1996

[30] Foreign Application Priority Data

| | | | |
|---|---|---|---|
| Oct. 31, 1995 | [JP] | Japan | 7-306504 |
| Dec. 21, 1995 | [JP] | Japan | 7-349820 |
| Sep. 26, 1996 | [JP] | Japan | 8-275493 |
| Sep. 27, 1996 | [JP] | Japan | 8-277574 |

[51] Int. Cl.[6] ..... G03G 15/08

[52] U.S. Cl. ..... 399/260

[58] Field of Search ..... 399/222, 252, 399/254, 255, 258, 259, 260, 264, 262, 265, 273, 274, 279, 281, 283, 284

[56] References Cited

U.S. PATENT DOCUMENTS

| | | | |
|---|---|---|---|
| 4,406,536 | 9/1983 | Suzuki et al. . | |
| 4,800,411 | 1/1989 | Tanaka et al. . | |
| 5,188,057 | 2/1993 | Ishikawa et al. | 399/274 X |
| 5,383,009 | 1/1995 | Tsusaka | 399/259 X |
| 5,502,552 | 3/1996 | Iwata et al. | 399/222 |

FOREIGN PATENT DOCUMENTS

| | | |
|---|---|---|
| 63-4278 | 1/1988 | Japan . |
| 63-225266 | 9/1988 | Japan . |
| 1-105975 | 4/1989 | Japan . |
| 2-116876 | 5/1990 | Japan . |
| 4-20061 | 2/1992 | Japan . |
| 4-85573 | 3/1992 | Japan . |
| 7-219327 | 8/1995 | Japan . |
| 8-185034 | 7/1996 | Japan . |
| 9-006113 | 1/1997 | Japan . |
| 9-022178 | 1/1997 | Japan . |

*Primary Examiner*—S. Lee

*Attorney, Agent, or Firm*—Oblon, Spivak, McClelland, Maier & Neustadt, P.C.

[57] ABSTRACT

A developing device for an image forming apparatus and capable of automatically controlling the toner content of a developer is disclosed. Even when the toner content of the developer deposited on a developer carrier and being conveyed toward a developing position becomes irregular due to some cause, the developer is prevented from remaining at the developing position. This guarantees a desired developing position despite the automatic toner content control. In addition, the toner content of the developer is prevented from increasing at portions adjoining the opposite ends of the developer carrier.

30 Claims, 13 Drawing Sheets

DEVELOPING DEVICE CAPABLE OF AUTOMATIC TONER CONTENT CONTROL

BACKGROUND OF THE INVENTION

The present invention relates to a developing device for use in a copier, facsimile apparatus, printer or similar image forming apparatus. More particularly, the present invention is concerned with a developing device of the type using a developer consisting of toner and carrier, developing a latent image electrostatically formed on an image carrier by holding the developer in contact with the surface of the image carrier, and replenishing toner into the developer deposited on a developer carrier on the basis of the movement of the developer caused by conveyance.

Developing devices capable of developing a latent image electrostatically formed on a photoconductive drum or similar image carrier with a two-ingredient type developer, i.e., a mixture of toner and carrier or magnetic particles are generally classified into two types, i.e., a noncontact type device and a contact type device. A noncontact type device develops the latent image by forming a magnet brush with the developer on a developing sleeve or similar developer carrier, but not causing the magnet brush to contact the surface of the image carrier. By contrast, a contact type device causes the magnet brush to contact the surface of the image carrier. Developing devices using the two-ingredient type developer and having an automatic toner content control capability are disclosed in, e.g., Japanese Patent Application Nos. 7-201454 and 7-119339 as well as in Japanese Patent Laid-Open Publication No. 63-225266. These devices are capable of maintaining the toner content of the developer deposited on the developing sleeve substantially constant without resorting to a special mechanism including a toner sensor and a toner replenishing member.

However, the problem with the device having the automatic toner content control capability and the contact type device is that irregular density appears in a developed image or toner image in the form of lines. We found that such irregular image density stems from the irregular toner content of the developer in the direction perpendicular to the direction in which the developing sleeve conveys the developer, i.e., in the axial direction of the sleeve. Specifically, the toner content of the developer locally increased on the sleeve in the axial direction, causing the corresponding portion of the image to be irregular in density. This was particularly critical at portions adjoining the opposite ends of the sleeve.

A series of extended researches and experiments showed that the above irregular image density is related to the remaining of the developer at a developing position between the image carrier and the sleeve. Assume that the toner content of the developer locally increases in the axial direction of the sleeve, and the portions with a higher toner content arrive at the developing position for contact development. Then, the developer locally remains at the developing position in the axial direction of the sleeve. This part of the developer causes the developing condition to vary and thereby brings about the irregular image density.

Particularly, in the case of the contact type device with the automatic toner content control capability, the developer remaining at the developing position causes the device to execute automatic control such that the toner content of the higher content portions to further increase. This aggravates the irregular toner content distribution. Why the irregular toner content distribution, is aggravated is as follows. For example, the developer remaining at the developing position in the form of a heap moves to adjoining regions in the axial direction of the sleeve in a landslide fashion. As a result, the developer decreases in amount in the higher content portions. Such a decrease in the amount of the developer is equivalent in effect to a local decrease in toner content. Consequently, the replenishment of fresh toner increases, resulting in the increase in the toner content of the developer. Also, the developer to be conveyed to a point downstream of the point where the developer remains decreases. This is equivalent in effect to a decrease in toner content.

The prerequisite with the device having the automatic toner content control capability is that the developer on the developer carrier be prevented from gathering at either side or locally dropping when the device is bodily tilted. To meet this prerequisite, a developer stored in a storing section may be held in a packed state so as to maintain a developer layer on the developer carrier constant in the axial direction of the developer carrier, as taught in, e.g., Japanese Patent Laid-Open Publication No. 64-105975. In this kind of device, magnetic field generating means is disposed in the developer carrier and extends in the axial direction in order to magnetically retain the developer on the developer carrier. The magnetic field generating means exerts a more intense magnetic force at its opposite end portions than at its intermediate portion. Further, the developer is regulated in width in a casing by side seals. Therefore, just after the developer has moved away from a gap between the developer carrier and a developer regulating member, it spreads to both sides. The above intensity distribution of the magnetic field generating means and the spread of the developer are apt to increase the toner content at the portions adjoining the opposite ends of the developer carrier. Such a problem is not even mentioned in the above document, not to speak of a countermeasure.

Developing devices relating to the present invention are also disclosed in Japanese Patent Laid-Open Publication Nos. 4-20061, 4-85573, 7-219327 and 2-116876 as well as in Japanese Patent Publication No. 5-67233.

SUMMARY OF THE INVENTION

It is therefore an object of the present invention to provide a developing device for an image forming apparatus and capable of preventing, when the toner content of a developer being conveyed by a developer carrier toward a developing position becomes irregular due to some cause, the developer from remaining at the developing position and thereby insuring desirable images.

It is another object of the present invention to provide a developing device with an automatic toner content control capability and capable of preventing the toner content of a developer from increasing at portions adjoining the opposite ends of a developer carrier.

In accordance with the present invention, in a developing device for an image forming apparatus and for developing a latent image electrostatically formed on an image carrier by conveying a developer to a developing position where the device faces the image carrier, a chamber is provided for receiving a two-ingredient type developer consisting of toner and magnetic particles. A developer carrier has a magnetic field generating section disposed thereinside, and conveys the developer to the developing position by magnetically retaining it. A developer regulating member regulates the amount of the developer deposited on the developer carrier by causing the developer to pass through a gap between the developer regulating member and the developer carrier. A toner storing section stores toner to be replenished into the developer, and is communicated to the chamber via an opening. A replenishment regulating device causes the toner to be introduced into the chamber in a smaller amount at portions adjoining opposite ends of the developer carrier in the widthwise direction of the developer carrier than at the intermediate portion.

Also, in accordance with the present invention, a developing device includes a developer carrier for conveying a developer consisting of toner and carrier to a developing position where the developer carrier faces an image carrier. A chamber adjoins the developer carrier for receiving the developer therein. The device develops a latent image electrostatically formed on the image carrier by holding the developer in contact with the surface of the image carrier, and replenishes toner into the developer deposited on the developer carrier on the basis of the movement of the developer caused by the conveyance of the developer. The developer deposited on the image carrier is so controlled as not to remain at the developing position.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
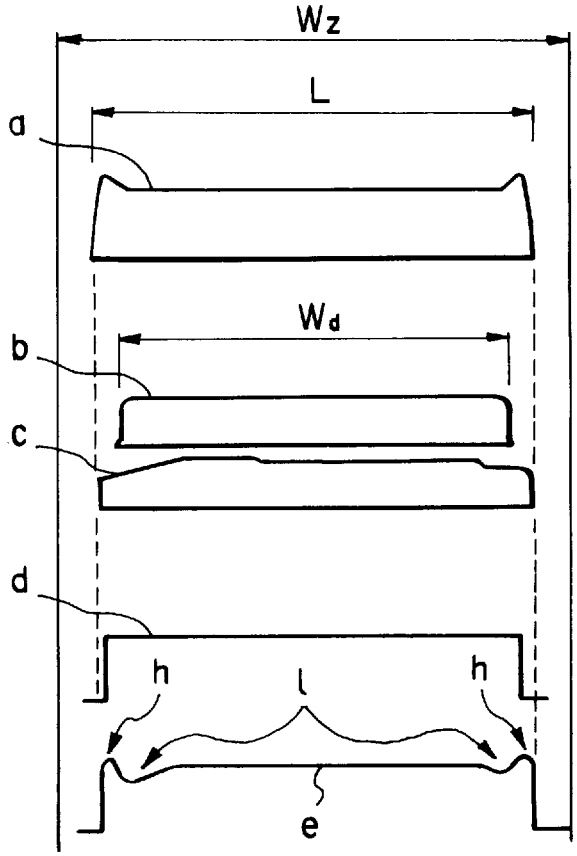
Fig. 1 PRIOR ART
FIG. 1 shows a distribution of magnetic force in the lengthwise direction of a developer carrier included in a conventional developing device, a distribution of the amount of developer for a unit area, and a distribution of the amount of magnetic particles for a unit length in the direction of rotation of the developer carrier.

To better understand the present invention, a brief reference will be made to a conventional developing device of the type using a two-ingredient type developer for the development of a latent image formed on a photoconductive drum or similar image carrier. FIG. 1 shows a distribution of magnetic force a of a developer carrier in the lengthwise direction, distributions b and c of a developer for a unit area deposited on the developer carrier, and distributions d and e of the amount of magnetic particles for a unit length deposited on the developer carrier in the lengthwise direction of the developer carrier.

Usually, to maintain the magnetic force retaining the developer on the developer carrier uniform, it is preferable that the magnetic force distribution in the lengthwise direction of the developer carrier be uniform. However, as the distribution a indicates, a magnet roller or magnetic field generating means extending within and in the lengthwise direction of the developer carrier over a length L exerts a more intense magnetic force at its opposite end portions than at its intermediate portion. Therefore, to set up a uniform magnetic force distribution over the entire image width, it is necessary that the length L be great enough to accommodate the entire image width in the intermediate portion of the roller where the magnetic force distribution is substantially uniform. However, the increase in length L results in an increase in the overall size of the device.

The opposite end portions of the magnet roller exhibit a higher conveying ability than the intermediate portion due to the magnetic force distribution stated above. Therefore, every time the magnetic particles deposited on the developer carrier move away from the developing position, they are caused to move to the opposite end portions of the developer carrier. For example, in FIG. 1, the magnetic particles uniformly retained on the entire developer carrier, as indicated by the distribution d, are sequentially shifted to the opposite end portions during conveyance. As a result, the particles gather at the end portions h of the developer carrier, as indicated by the distribution e. At the same time, the amount of magnetic particles for a unit length existing on portions l adjoining the opposite ends h decreases.

Assume that the decrease in the amount of magnetic particles at the portions l occurs in the device having the automatic toner content control capability and taught in Laid-Open Publication No. 63-225266 or in the device taught in Application No. 7-119340. Then, the replenishment of toner into the developer remaining portion increases at the portions l. As a result, the toner content increases at the portions adjoining the opposite ends of the resulting image.

Figure 2:
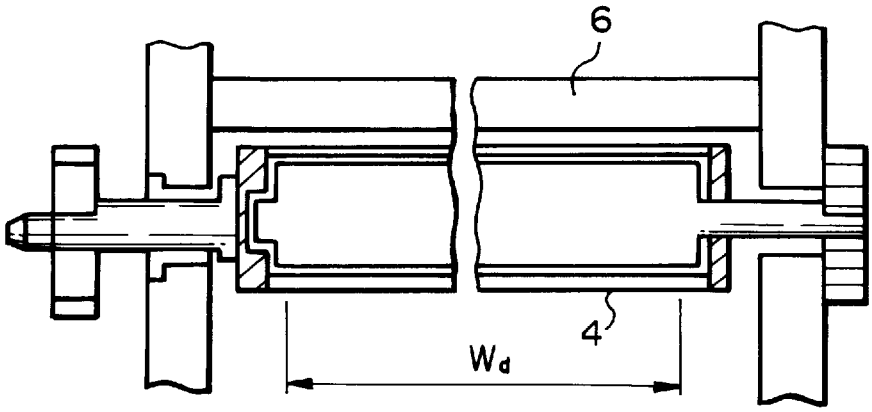
Fig. 2 PRIOR ART
FIG. 2 is a sectional side elevation of the developer carrier and a developer regulating member included in the conventional device.

FIG. 2 shows the arrangement of a developer carrier 4 and a developer regulating member 6 included in a conventional developing device. As shown, the surface of the developer carrier 4 and the edge of the regulating member 6 are spaced by a predetermined gap. Side seals, not shown, are positioned upstream of the gap in the intended direction of developer conveyance. The side seals limit a width Wd over which the developer passing through the gap can exist in a casing. Therefore, the regulating member 6 limits the amount of the developer for a unit area on the developer carrier 4 substantially uniformly to, e.g., 0.4 g/cm$^2$, as measured from the surface of the carrier 4. As a result, the developer passing through the above gap exists over the width Wd, as indicated by the distribution b in FIG. 1.

However, the developer just moved away from the gap spreads to both sides outside of the width Wd. As a result, the amount of magnetic particles for a unit area decreases at the portions adjoining the opposite ends of the developer carrier 4 in the widthwise direction. In addition, a magnetic roller received in the developer carrier 4 shifts the decreased amount of developer particles toward the ends h, FIG. 1. This further reduces the amount of magnetic particles existing in the portions l adjoining the intermediate portion. consequently, the toner content increases at the portions of the developer carrier adjoining the opposite ends due to the automatic toner content control.

Generally, an image is scarcely formed in the portions of the developer carrier 4 adjoining the opposite ends and where the toner content increases, compared to the intermediate portion. Therefore, the toner consumption is far less at the above portions than at the intermediate portion. This aggravates the increase in toner content.

Preferred embodiments of the developing device in accordance with the present invention and applied to an electrophotographic copier by way of example will be described.

1st Embodiment

Figure 3A:
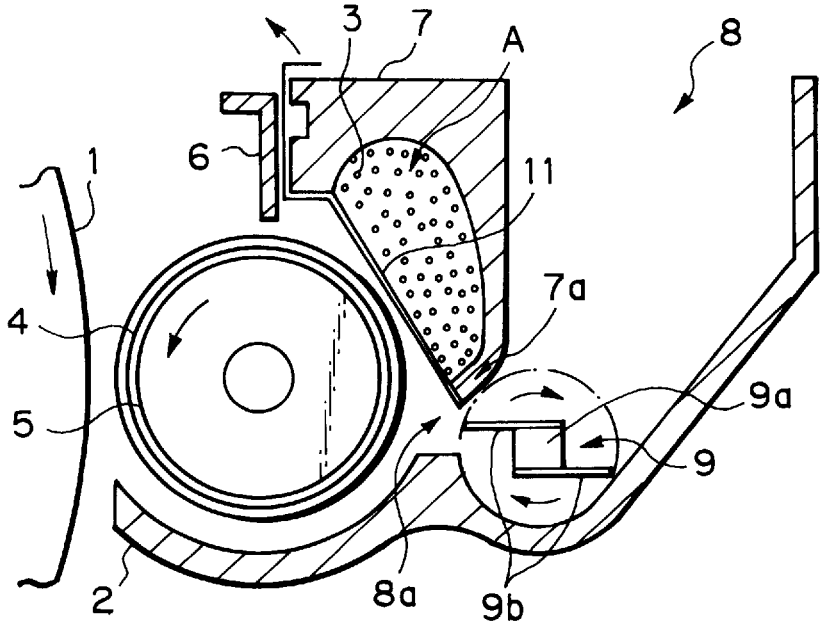
FIG. 3A is a section showing a first embodiment of the developing device in accordance with the present invention and including a developer container with a seal.
Figure 3B:
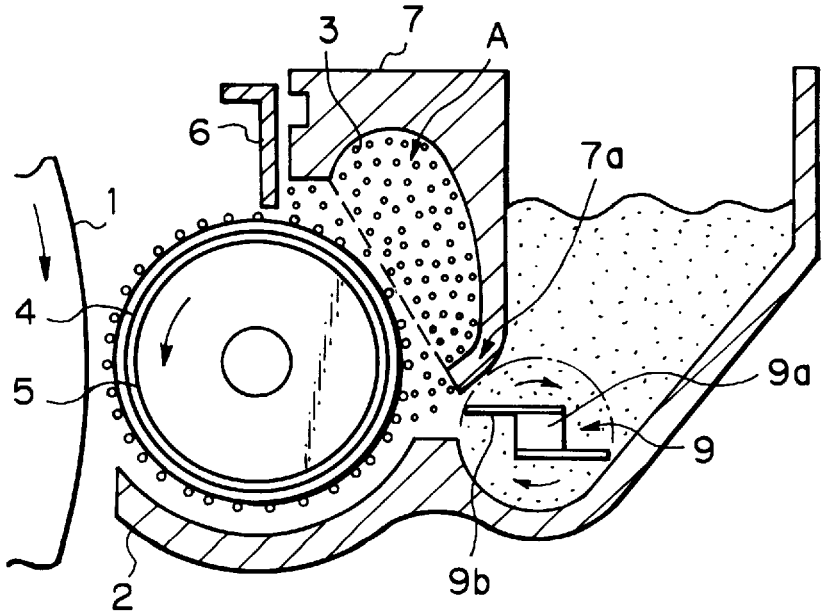
FIG. 3B is a view similar to FIG. 3A, showing the developer container in a condition wherein the seal has been removed.

Referring to FIGS. 3A and 3B, a developing device embodying the present invention includes a casing 2 positioned at one side of a photoconductive drum or image carrier 1. The casing 2 has an opening facing the drum 1. A developing sleeve or developer carrier 4 is partly exposed to the outside through the opening of the casing 2. A developer 3 consists of toner and magnetic particles, or carrier, and deposits on the surface of the sleeve 4. A magnet roller 5 is fixed in place within the sleeve 4 and made up of a group of stationary magnets playing the role of magnetic field generating means. A doctor blade or developer regulating means 6 regulates the amount of the developer 3 being conveyed by the sleeve 4 toward a developing position where the drum 1 and sleeve 4 face each other. A chamber forming member or developer container 7 has an opening facing the sleeve 4 and forms a chamber A which accommodates the developer 3 remaining above the sleeve 4. The casing 2 includes a toner hopper 8 located at the opposite side to the drum 1 with respect to the sleeve 4. Fresh toner is stored in the toner hopper 8.

The wall of the chamber A is spaced a preselected distance from the surface of the sleeve 4. The part of the developer shaved off from the sleeve 4 by the doctor blade 6 is received in the chamber A. One magnetic pole of the magnet roller 5 faces the chamber A at the inside of the sleeve 4. The chamber forming member 7 includes a penthouse-like portion 7*a* extending from the vicinity of the doctor blade 6 and bent downward, thereby dividing the chamber A from the hopper 8. The bottom of the casing 2 is partly raised to delimit the toner hopper 8 at the sleeve 4 side. The lower edge of the penthouse 7*a* and the above raised portion of the casing 2 are spaced a preselected distance from each other. The gap between the lower edge of the portion 7*a* and the raised portion of the casing 2 serves as an opening 8*a* for replenishing the toner from the hopper 8. The opening 8*a* adjoins the upstream side of the chamber A with respect to the direction of developer conveyance and faces the surface of the sleeve 4. An agitator 9 is disposed in the hopper 8 in the vicinity of the opening 8*a*. The agitator 9 drives the toner toward the opening 8*a* while agitating it.

In the illustrative embodiment, the agitator 9 includes a shaft 9*a* having a square section and extending widthwise with respect to the toner feed direction. Flat members or blades 9*b* are formed of, e.g., PET (polyethylene terephthalate) and affixed to two parallel sides of the shaft 9*a*. The blades 9*b* each extends out from the shaft 9*a* to the downstream side in the direction of rotation of the shaft 9*a* over a preselected dimension. While the shaft 9*a* is in rotation, the blades 9*a* feed the toner toward the opening 8*a* while agitating it. Therefore, as the distance between the axis of the shaft 9*a* and the free edge of each blade 9*a* increases, the ability of the agitator 9 to agitate the toner increases. This allows the toner to be fed toward the chamber A with high efficiency.

While the sleeve 4 rotates in a direction indicated by an arrow and conveys the developer 3 toward the developing position, the doctor blade 6 regulates the amount of the developer 3 for thereby forming a thin developer layer on the sleeve 4. The drum 1 rotates in a direction also indicated by an arrow. At the developing position, the toner included in the thin developer layer is transferred to a latent image electrostatically formed on the drum 1. As a result, the latent image turns out a toner image. The part of the developer not used for the development is conveyed by the sleeve 4 toward the opening 8*a*. This part of the developer takes in the fresh toner fed by the agitator 9 via the opening 8*a*, and then returns to the chamber A due to the rotation of the sleeve 4.

The developer 3 taken in the fresh toner and returned to the chamber 3 increases the internal pressure of the developer derived from the regulation by the doctor blade 6. As a result, the toner contained in the developer 3 on the sleeve 4 is dispersed and discharged. This eliminates the need for a complicated mechanism for charging or agitating the developer 3, e.g., a paddle or a screw.

On the other hand, the developer 3 shaved off by the doctor blade 6 is partly caused to move toward the opening 8*a* in the chamber A due to its own internal pressure and gravity. On approaching the opening 8*a*, this part of the developer 3 is recirculated toward the doctor blade 6 due to the rotation of the sleeve 4.

Figure 4A:
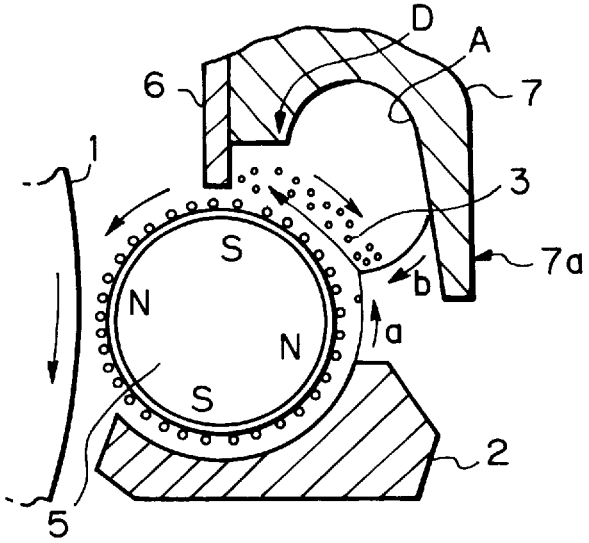
FIG. 4A is a fragmentary view showing a condition before the replenishment of toner to carrier.
Figure 4B:
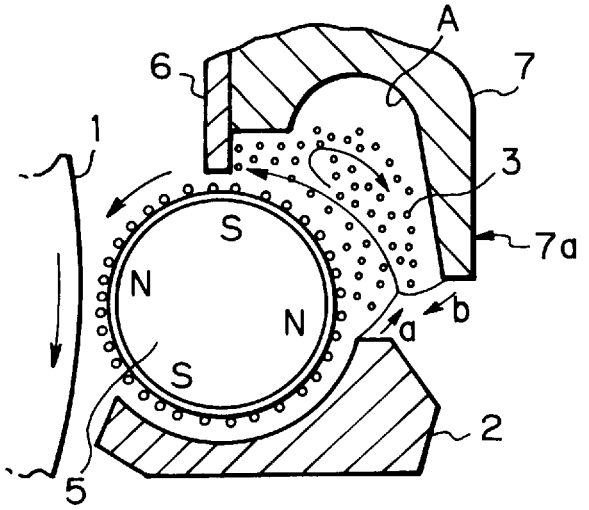
FIG. 4B is a view similar to FIG. 4A, showing a condition during replenishment.
Figure 4C:
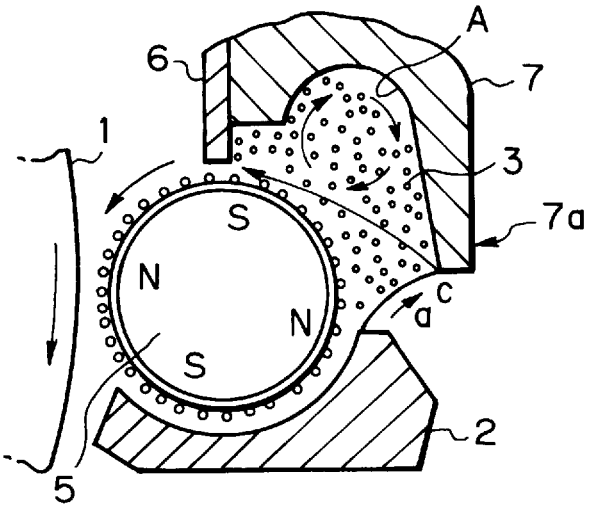
FIG. 4C is a view similar to FIG. 4A, showing a condition after the replenishment.

FIGS. 4A–4C demonstrates how the developer 3 moves in the chamber A specifically. As shown, the developer 3 conveyed to the doctor 6 is partly caused to flow toward the penthouse 7*a* over the sleeve 4 and begin to rotate in the chamber A. The rotation of the developer 3 can be observed by use of high-speed video and a rate of 200 frames per second and about 10 times higher speed. For this purpose, toner of different color is used.

As shown in FIG. 4A, the toner driven out of the hopper 8 is introduced into the developer at a point c where a flow a and a flow b join each other. At this instant, the developer is moving in the vicinity of the surface of the sleeve 4 at a rate of about 100 mm/sec. Because a sufficient space is available in the chamber A, the developer remaining above the sleeve 4 in the form of a layer rotates at a rate of about 10 mm/sec.

FIG. 4B shows a condition wherein the carrier of the developer 3 begins to taken in the toner. As the carrier sequentially takes in the toner, the toner content and the volume of the developer increase. As a result, the moving layer of the developer expands and causes the above point c to sequentially move away from the surface of the sleeve 4. At the same time, the flow speed a of the developer around the surface of the sleeve 4 decreases. The developer 3 is moving around the surface of the sleeve 4 at a rate of about 65 mm/sec while the remaining layer of the developer is rotating at a rate of about 5 mm/sec.

As shown in FIG. 4C, the space available in the chamber A sequentially decreases due to the increasing toner content and the increasing volume of the developer 3. As a result, the fluidity of the developer 3 sequentially decreases. In this condition, as the moving layer of the developer expands, the point c sequentially approaches the lower edge of the penthouse 7*a*. The developer 3 therefore stops taking in the toner. At this instant, the remaining layer of the developer is rotating at a rate of about 1 mm/sec. However, the remaining layer still includes a portion where the developer is remaining in a comparatively loose state. This part of the developer 3 has a higher toner content than the other part and is still rotating although the flow speed is low. In this part of the developer 3, the dispersion of the toner into the developer and the charging of the toner are continuously effected.

As the toner is consumed due to repeated development, the toner content and therefore the volume of the developer 3 in the chamber A decreases. As a result, the condition shown in FIG. 4A is restored and again causes the developer 3 to take in the fresh toner. In this case, not only the fresh toner taken in by the developer 3 but also the toner dispersed in the developer and charged while in rotation are conveyed to the developing position. This allows a great amount of toner to join in the development. Therefore, even when a great amount of fresh toner is introduced into the developer, the embodiment does not bring about the contamination of background and the fly-about of toner which have been discussed in relation to Japanese Patent Publication No. 5-67233.

By the above procedure, the toner content of the developer 3 is held in a preselected range. This makes it needless to use a sophisticated toner content control mechanism including a toner content sensor and a toner replenishing member.

Figure 3C:
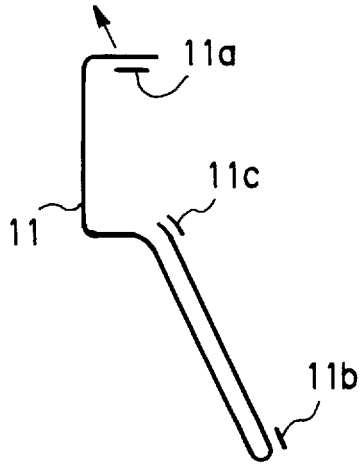
FIG. 3C is a section showing how the seal is configured to close an opening for communicating the chamber of the developer container to the body of the developing device.

The embodiment further includes an implementation for facilitating the setting of the developer in the developing device, as follows. As shown in FIG. 3A, the chamber forming member 7 is removably mounted to the body of the device. The member 7 stores carrier therein and has its opening closed by a shutter member or seal 11. Specifically, as shown in FIG. 3C, the seal 11 is adhered to the top of the member 7 at its upper end 11*a*. Then, the seal 11 is extended from the portion of the member 7 which will face the doctor blade 6 to the lower edge of the above opening, spanning the entire opening. Subsequently, the seal 11 is turned over toward the chamber A at its portion 11*b*. The portion 11*b* is adhered to the lower end portion of the penthouse 7*a*. The portion of the seal 11 turned over toward the chamber A has its upper end 11*c* adhered to the portion of the member 7 corresponding to the upper end of the opening. To uncover the opening, the seal 11 has its upper end 11*a* peeled off from the surface of the member 7 and then pulled upward.

Specifically, to set fresh carrier in the chamber A by use of the above member 7, the member 7 with the developer and seal 11 is mounted to the device body. Then, the seal 11 is pulled out upward in order to uncover the opening of the member 7. As a result, the carrier stored in the member 7 drops onto the sleeve 1 due to its own weight. This kind of configuration facilitates the manipulation for setting the carrier in the developing device.

Figure 3D:
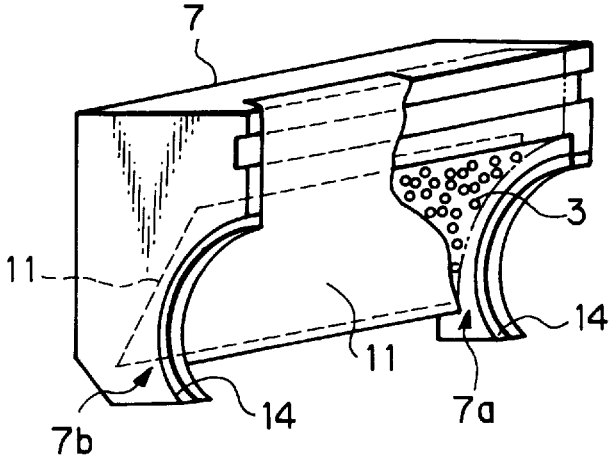
FIG. 3D is a perspective view of the developer container.

FIG. 3D shows the member 7 storing the fresh developer and closed by the seal 11 in a partly taken away perspective view. There are additionally shown in FIG. 3D side walls 7*b* and side seals 14 which are fitted on the portions of the side walls 7*b* to face the sleeve 4.

Figure 5A:
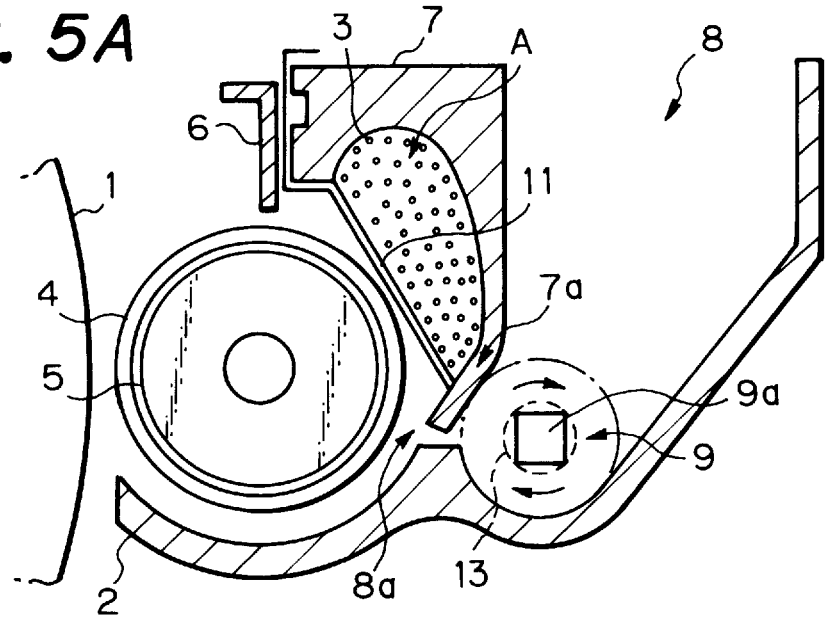
FIG. 5A is a view similar to FIG. 3A, showing the end portion of an agitator.
Figure 5B:
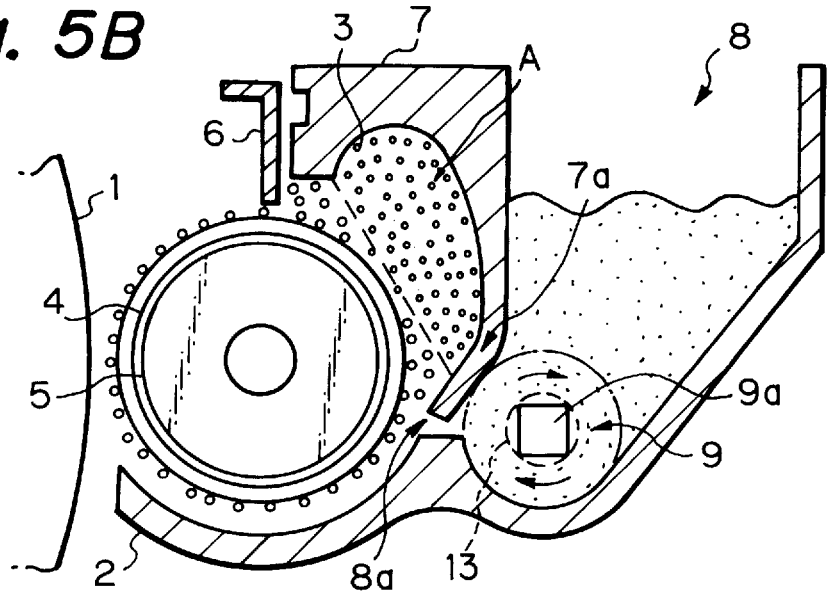
FIG. 5B is a view similar to FIG. 3B, also showing the end portion of the agitator.
Figure 5C:
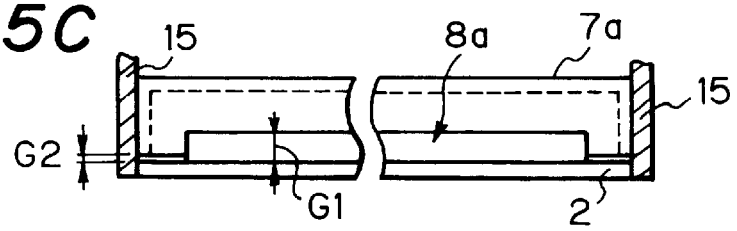
FIG. 5C is a front view showing an opening for replenishing toner.

Further, the illustrative embodiment includes a structure for preventing the toner density from increasing above a desired value at opposite end portions of an image in the widthwise direction. FIGS. 5A–5C show the end portion of the agitator 9 and the opening 8*a* for toner replenishment in detail. As shown in FIG. 5C, the gap between the lower edge of the penthouse 7*a* and the casing 2 is formed stepwise. Specifically, the gap consists of a greater gap G1 extending over the opening 8*a,* and smaller gaps G2 extending at opposite sides of the opening 8*a*. More specifically, the lower end of the penthouse 7*a* is extended downward toward the casing 2 only at its portions for forming the smaller portions G2. In addition, as shown in FIGS. 5A and 5B, the blades 9*b* of the agitator 9 are each removed at its opposite end portions.

After the member 7 with the carrier and seal 11 has been mounted to the device body, as shown in FIG. 5A, the seal 11 is pulled out upward in order to uncover the opening of the chamber A, as shown in FIG. 5B. As a result, the carrier drops onto the sleeve 4, as stated earlier. Then, the agitator 9 starts rotating. The shaft 9*a* having a square section forms the outermost locus of rotation 13. The locus 13 is far smaller at the opposite end portions of the agitator 9 than at the intermediate portion where the blades 9*a* are present. Therefore, the agitator 9 drives a smaller amount of toner toward the chamber A at its opposite end portions than at its intermediate portion. This, coupled with the fact that the gap between the lower edge of the penthouse 7*a* and the casing 2 is stepwise, allows the toner to be surely fed to the chamber A in a smaller amount at the opposite end portions than at the intermediate portion.

With the above configuration, it is possible to prevent the toner content of the developer from increasing at the opposite end portions of the sleeve 4. The toner content tends to increase at the opposite end portions when the toner is consumed in a smaller amount at the end portions than at the intermediate portion or when the carrier moves toward the end portions where the magnetic force of the magnet roller 5 is intense. Further, the increase in the toner content at the end portions of the sleeve 4 would cause the toner to fly bout, would contaminate the background of an image, and would render the image density irregular. Moreover, the amount in which the toner can be taken into the chamber A can be adjusted in the widthwise direction of the chamber A, depending on the presence/absence of the blades 9*b* on the shaft 9*a* and on the size of the gap forming the opening 8*a*. Experiments showed that the gap G1 at the intermediate portion of the opening 8*a* should preferably lie in the range of 1 mm$\leqq$G1$\leqq$5 mm.

Figure 6A:
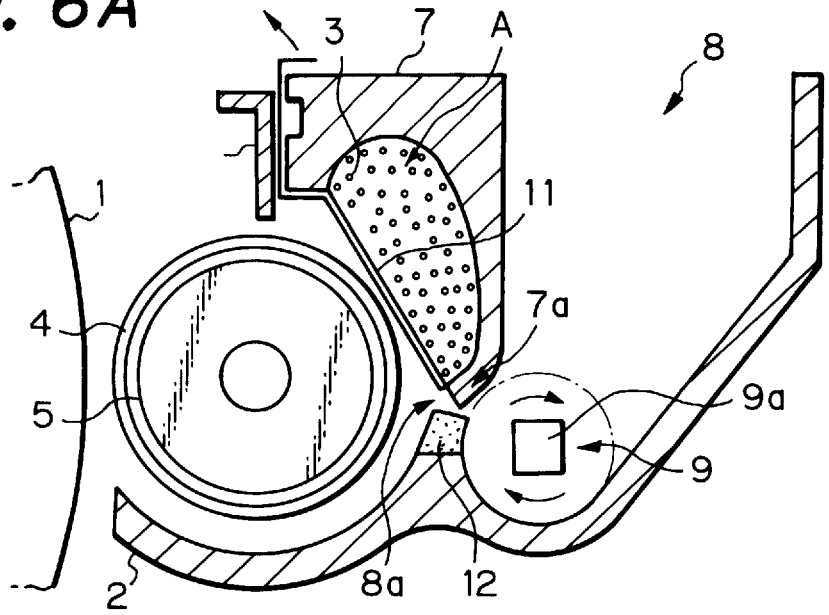
FIG. 6A is a view similar to FIG. 5A, showing a modification of the first embodiment and the end portion of the agitator.
Figure 6B:
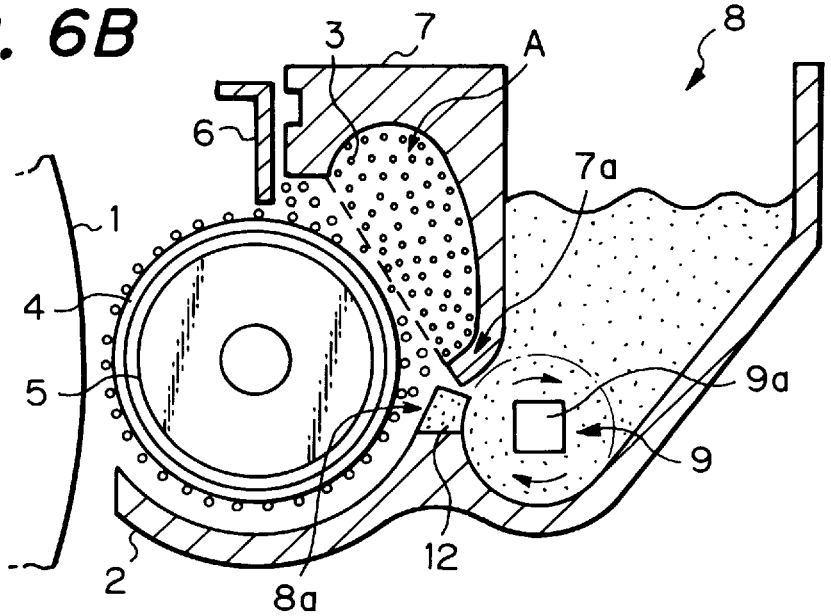
FIG. 6B is a view similar to FIG. 5B, showing the end portion of the agitator.
Figure 6C:
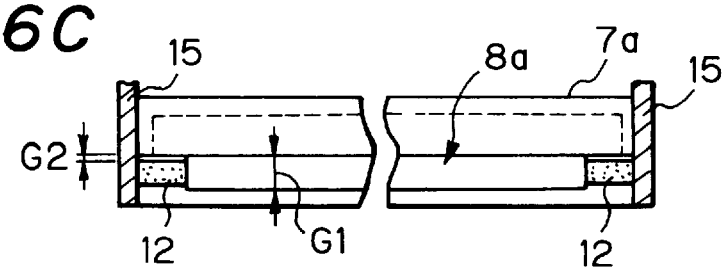
FIG. 6C is a front view showing an opening included in the modification.

FIGS. 6A–6C show a modification of the first embodiment. As shown, elastic members or replenishment regulating means 12 are fitted on the portions of the casing 2 which face the opposite end portions of the opening 8*a*. The elastic members 12 and the lower edge of the penthouse 7*a* form the smaller gaps G2 therebetween. The agitator 9 has the configuration shown in FIGS. 5A–5C. The modification is comparable in advantage with the first embodiment.

In the embodiment and its modification, only one of the gap forming the opening 8*a* and the blades 9*b* of the agitator may be so configured as to reduce the amount of toner replenishment at the opposite end portions of the opening 8*a,* if desired. This simplifies the configuration for reducing the amount of toner replenishment at the above portions.

The opening 8*a* may have its dimension reduced in the widthwise direction in order to prevent the toner content from increasing at the opposite end portions of an image. For this purpose, the lower edge of the penthouse 7*a,* FIG. 5C, or the height of the elastic members 12, FIG. 6C, may be so configured as to make the gap G2 zero.

Figure 7A:
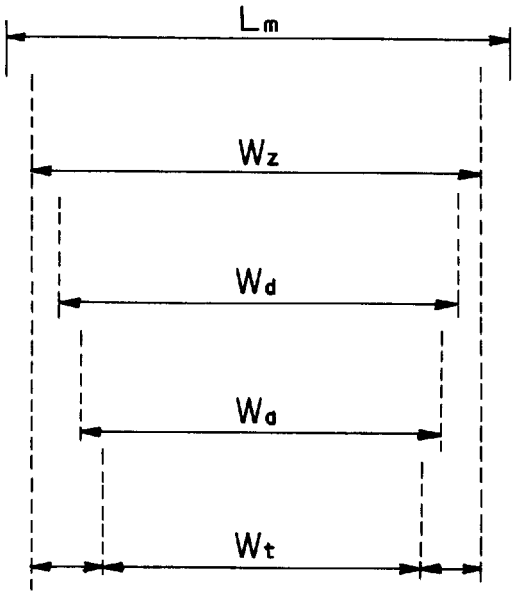
FIGS. 7A and 7B are views comparing the width of the opening and the widths of various members.

FIG. 7A shows the width of the opening 8*a* reduced for the above purpose and the widths of other members for comparison. There are shown in FIG. 7A the length Lm of the magnet roller 5 in the lengthwise direction, the width Wz of the chamber A in the same direction as the length Lm, the distribution Wd of the developer passing the doctor blade 6, the width Wa of an image area, and the width Wt of the opening 8*a*. Generally, the length Lm of the roller 5 is selected to be more than ten millimeters greater than the width Wa of the image area in order to free images from the influence of the magnetic field which sharply changes at the opposite end portions of the roller 5. This is also true with the configuration shown in FIG. 7A. Further, the width Wz of the chamber A is usually selected to lie in a range insuring the uniform magnetic retaining force of the roller 5, and to be greater than the width Wa, so that the developer can be fed to the image area in a uniform amount by the uniform retaining force in the widthwise direction. This is also true with the configuration shown in FIG. 7A.

In FIG. 7A, the width Wt of the opening 8*a* is selected to be smaller than the length Lm of the magnet roller 5 such that the opposite ends of the former are closer to the center than those of the latter. Regarding the width Wt of the opening Wt, we found that the width Wt should preferably be about 10 mm smaller than the roller 5, as measured from each end of the roller 5. This, however, depends on the developing device because the magnetic field distribution of the main pole for development depends on the developing roller. Generally, the width Wt should preferably avoid the end portions of the roller 5 where the intense magnetic force acts, as indicated by the distribution a in FIG. 1.

The configuration shown in FIG. 7A reduces the amount in which the toner is fed to the portions of the sleeve 4 corresponding to the end portions of the magnet roller 5. Therefore, even when the carrier moves from the inside toward the outside in the axial direction of the sleeve 4 due to the magnetic force distribution of the roller 5, it is possible to prevent the toner content from increasing to an unusual degree at the end portions of the sleeve 4. This also obviates the fly-about of the toner, contamination of the interior of the apparatus, contamination of the background, irregular image density and other troubles ascribable to such an increase in toner content.

Figure 8:
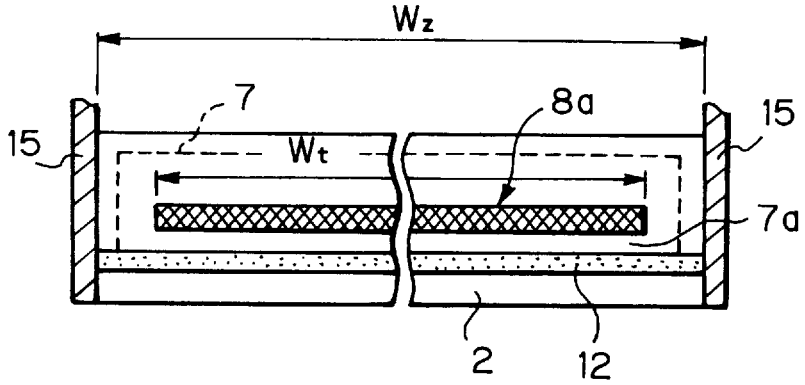
FIG. 8 is a front view showing a specific configuration of the opening included in the first embodiment.

Further, in FIG. 7A, the width Wt of the opening 8*a* is smaller than the width Wz of the chamber A at its opposite ends. FIG. 8 shows a specific configuration in which the width Wt is smaller than the distance between the side walls of the casing. In FIG. 8, the width Wz of the chamber A is delimited by the side walls of the casing. The gap between the lower edge of the developer container, which intervenes between the chamber A and the toner hopper 8, and the raised portion of the casing 2 is hermetically sealed by an elastic member 12. The opening 8*a* is positioned a preselected distance above the lower edge 7*a* of the penthouse 7. The opening 8*a* has a desired length between the side walls and has a desired width in the up-and-down direction. A wire net covers the opening 8*a* in order to maintain the toner content uniform in the lengthwise direction of the opening 8*a*. If desired, the opening 8 may be provided with punch metal or ribs in order to maintain its width in the up-and-down direction uniform.

Regarding the width Wt of the opening 8*a,* we found that it should preferably be about 2.5 mm to 5 mm smaller than the width between the opposite ends of the chamber A, as measured from each end of the chamber A. Again, this depends on the developing device because the magnetic field distribution of the main pole for development depends on the developing roller. In addition, in the illustrative embodiment, the width Wt of the opening 8*a* is selected to be smaller than the width Wa of the image area.

The width Wt of the opening 8*a* may be made smaller than the width Wz of the chamber A by the following configuration. The height of the elastic members 12 shown in FIGS. 6A–6C is so selected as to make the gap G2 zero, as stated earlier. In addition, the width of each elastic member 12 is so determined as to extend into the chamber A beyond the thickness of the end wall of the member 7.

In the above configuration, the toner is replenished into the developer existing in the chamber A via the opening 8*a* whose width Wt is smaller than the width Wz of the chamber A. As a result, the toner is fed in a smaller amount to the end portions of the sleeve 4 than to the intermediate portion of the same, i.e., to the end portions of the image area than to the intermediate portion of the same. This prevents the toner density from increasing to an unusual degree at the end portions of the image area.

Figure 7B:
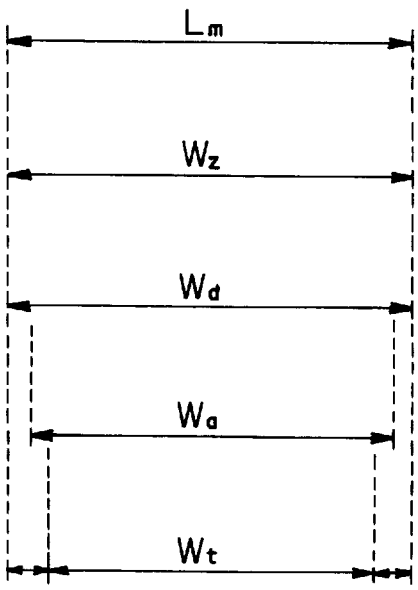

FIG. 7B shows another specific configuration in which the opening 8*a* has the above configuration. In FIG. 7B, Lm, Wz, Wd, Wa and Wt denote the same dimensions as in FIG. 7A. As shown, the length Lm of the magnet roller 5, i.e., the effective magnetization length, the width Wz of the chamber A, and the developer distribution Wd around the doctor blade 6 are identical. The width Wa of the image area (maximum size in the widthwise direction) is smaller than the width Wt of the opening 8*a*. For example, Lm, Wz and Wd are 304 mm each, Wa is 297 mm, and Wt is 287 mm. This configuration is comparable in advantage with the configuration shown in FIG. 7A.

As stated above, the first embodiment and its modifications have the following advantages.

(1) Replenishment regulating means allows toner to be introduced into a developer chamber in a smaller amount at the opposite end portions of a developer carrier than at the intermediate portion. It is therefore possible to prevent the toner content of the developer from increasing at the opposite end portions of the developer carrier. The toner content tends to increase at the opposite end portions when the toner is consumed in a smaller amount at the end portions than at the intermediate portion or when carrier moves toward the end portions where the magnetic force of magnetic field generating means is intense. Further, the increase in the toner content at the end portions of the developer carrier would cause the toner to fly about, would contaminate the background of an image, and would render the image density irregular.

(2) To set fresh carrier in the body of the image forming device, a developer container with a shutter member closing its opening is mounted to the device body, and then the shutter member is removed. As a result, the carrier stored in the container drops into the developing device. This facilitates the manipulation for setting the carrier in the developing device.

(3) At the opposite end portions of the magnetic field generating means where the magnetic retaining force is more intense than the other portion, the carrier or magnetic particles tend to gather away from the intermediate portion. Therefore, the toner content of the developer is apt to increase at the opposite end portions. In the embodiment and its modifications, the amount of toner supply to the portions adjoining the end portions of the magnetic field generating means is reduced. This prevents the toner content from increasing to an unusual degree at the above end portions.

(4) An opening for feeding the toner to the developer existing in the chamber has a width smaller than the width of the chamber, so that the toner is fed in a smaller amount at the end portions of the developer carrier than at the intermediate portion. Therefore, even when the amount of toner consumption is small at the end portions of the developer carrier, the toner content of the developer is prevented from increasing to an unusual degree at the end portions.

(5) The ability of a toner conveying member to convey the toner is reduced at the end portions of the above opening, so that the toner is fed to the chamber in a smaller amount at the end portions of the developer carrier than at the intermediate portion. This also achieved the above advantage (4).

(6) The amount of toner to be fed to the chamber via the opening is adjusted by lowering the conveying ability of the toner conveying member at the end portions of the member. This simplifies the arrangement for regulating the amount of toner to be replenished. Particularly, this can be done only if the maximum locus of rotation which the outermost portion of the toner conveying member forms is reduced only at the end portions of the member.

2nd Embodiment

Figure 9:
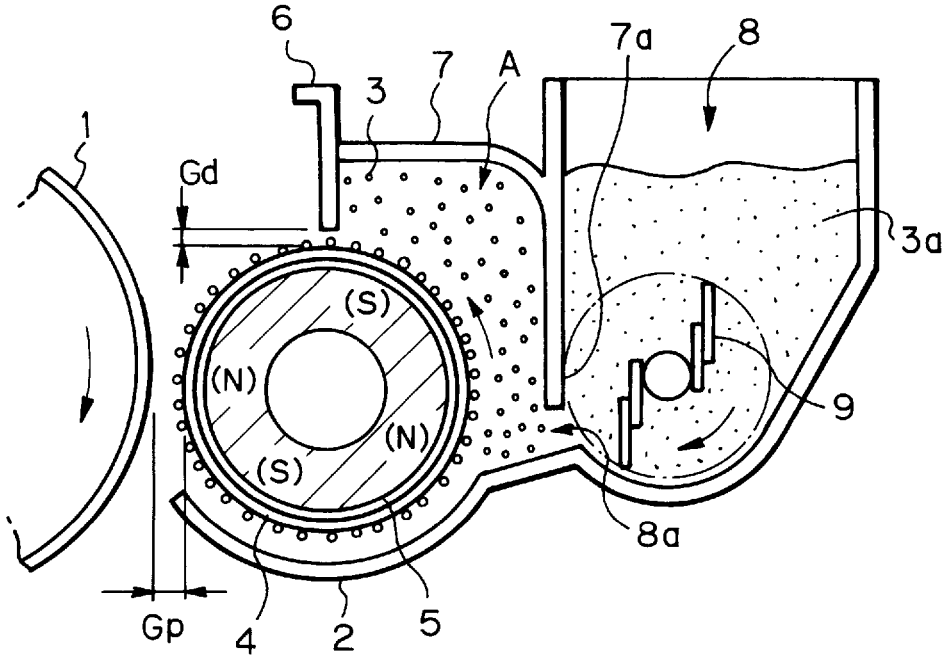
FIG. 9 is a section showing a second embodiment of the present invention.

Referring to FIG. 9, an alternative embodiment of the present invention will be described. In FIG. 9, the same or similar structural elements as or to the elements of the first embodiment are designated by identical reference numerals, and a detailed description thereof will not be made in order to avoid redundancy. The magnet roller 5 has magnetic poles S and N, as illustrated.

In the illustrative embodiment, the developer is implemented as a mixture of magnetic toner and magnetic carrier although the magnetic toner may be replaced with a non-magnetic toner. For the magnetic toner, use is made of one consisting of binding resin and magnetic substance and produced by any of conventional methods. For example, a mixture of binding resin, magnetic substance, coloring agent and polarity control agent may be kneaded by a heat roll mill, cooled, pulverized, and sieved. Any suitable additive may be added to the toner, as needed. The magnetic carrier may be implemented by iron powder carrier or ferrite-based magnetite. The carrier may have an amorphous shape or a spherical shape.

The magnetic toner used in the embodiment had a true specific gravity of 1.85 g/cc and a volumetric mean particle size of 7.5 $\mu$m The magnetic carrier had a true specific gravity of 5.2 g/cc and a volumetric mean particle size of 50 $\mu$m. An arrangement was so made as to control the toner content to a target content of 20 wt % which sets up a substantially 100% carrier covering ratio (Tn) of the toner. The relation between the carrier covering ratio Tn (%) and the toner content C (wt %) is expressed as:

$$Tn=C[(\sqrt{3})\cdot R^3\cdot \rho c/\{2\pi(R+r)^2\cdot r\cdot \rho t\}+1] \quad \text{Eq. (1)}$$

$$Tn=C[(\sqrt{3})\cdot \rho c/\{2\pi(1+r/R)^2\cdot (r/R)\cdot \rho t\}+1] \quad \text{Eq. (2)}$$

where C is the toner content (wt %), r is the radius of the toner, R is the radius of the magnetic carrier, ρt is the true specific gravity of the toner, and ρc is the specific gravity of the magnetic carrier.

Assume that the developer deposited on the sleeve 4 consists of carrier and toner. Then, if the upper limit of toner content is so selected as to set up a carrier covering ratio between 60% and 100%, desirable toner images are achievable, as determined by experiments. Should the carrier covering ratio be lower than 60%, the amount of charge to deposit on the toner would be excessively high and would lower the image density to a critical degree. Covering ratios above 100% would contaminate the background of images.

For example, when the above covering ratio is 100%, the toner covers a single carrier particle in a single layer. In this condition, even if the developer on the sleeve 4 is pressed against the drum 1, the carrier is prevented from contacting the drum 1. This successfully prevents the carrier from depositing on the drum 1. It was found that covering ratios above 60% prevent excessive charges from depositing on the toner and thereby obviate short image density. For the experiments, magnetic carrier having a specific gravity of 5.2 (g/cm$^3$) and a particle size of 50 ($\mu$m) and magnetic toner having a specific gravity of 1.84 (g/cm$^3$) and a particle size of 7.5 $\mu$m were used.

The embodiment uses contact development, i.e., develops a latent image formed on the drum 1 by causing a magnet brush formed on the sleeve 4 to contact the drum 1. A DC power source, not shown, applies a DC bias voltage to the sleeve 4. This type of developing device is practicable with an inexpensive DC power source, compared to a noncontact (jumping) type developing device needing an AC-biased DC power source.

While the sleeve 4 rotates in a direction indicated by an arrow and conveys the developer 3 toward the developing position, the doctor blade 6 regulates the amount of the developer 3 for thereby forming a thin developer layer on the sleeve 4. The drum 1 rotates in a direction also indicated by an arrow. At the developing position, the toner included in the thin developer layer is transferred to a latent image electrostatically formed on the drum 1. As a result, the latent image turns out a toner image. The part of the developer not used for the development is conveyed by the sleeve 4 toward the opening 8*a*. This part of the developer takes in the fresh toner fed by the agitator 9 via the opening 8*a,* and then returns to the chamber A due to the rotation of the sleeve 4.

The developer 3 taken in the fresh toner and returned to the chamber 3 increases the internal pressure of the developer derived from the regulation by the doctor blade 6. As a result, the toner contained in the developer 3 on the sleeve 4 is dispersed and discharged. This eliminates the need for a complicated mechanism for charging or agitating the developer 3, e.g., a paddle or a screw.

On the other hand, the developer 3 shaved off by the doctor blade 6 is partly caused to move toward the opening 8*a* in the chamber A due to its own internal pressure and gravity. On approaching the opening 8*a,* this part of the developer 3 is recirculated toward the doctor blade 6 due to the rotation of the sleeve 4.

The toner driven out of the toner hopper 8 is introduced into the developer at a point where the moving layer of the developer above the sleeve 4 and the remaining layer of the developer in the chamber A join each other. At this instant, when the toner content and therefore the volume of the developer on the sleeve 4 is reduced, the above point is close to the surface of the sleeve 4, so that both the moving layer and the remaining layer move at a relatively high speed. Therefore, the toner can be introduced into the developer in a desirable manner. On the other hand, when the toner content and therefore the volume of the developer on the sleeve 4 increases, the above point moves away from the surface of the sleeve 4. This, coupled with the fact that the fluidity of the developer decreases, interrupts the replenishment of the toner into the developer.

As stated above, the volume of the developer varies with the varying condition of replenishment of the toner, so that the toner content is automatically controlled. This successfully maintains the toner content of the developer 3 in a substantially constant range and thereby eliminates the need for a complicated toner content control mechanism including a toner content sensor and a toner replenishing member.

In the illustrative embodiment, the target toner content for the automatic control is 20 wt %. The toner content can be controlled within the range of from 10 wt % (when the toner consumption is great) to 25 wt %.

It sometimes occurs that the toner content is irregular, i.e., locally high in the lengthwise (axial) direction of the sleeve 4 due to some cause. For example, this occurs when the amount of carrier is locally small in the chamber A in the lengthwise direction of the sleeve 4, when the gap (doctor gap) Gd between the surface of the sleeve 4 and the edge of the doctor blade 6 is locally increased in the lengthwise direction of the sleeve 4, or when the dispersed state of the replenished toner varies. When the portion of the developer having a toner content higher than the target value arrives at the doctor blade 6, the magnetic obstructing force acts little, compared to the other portion in the lengthwise direction of the sleeve 4. This, coupled with the fact that the coefficient of friction acting between the developer and the sleeve 4 increases due to the fall of fluidity of the developer, causes the developer to pass the blade 6 in a greater volume than expected.

When the developer moved away from the doctor blade 6 in a greater amount reaches the developing position, the height of the magnet brush becomes higher at the above portion than at the other portion. As a result, the developer is apt to remain at the developing position. Then, the amount of the developer become short at the downstream end of the developing position with respect to the direction of rotation of the sleeve 4. Moreover, the developer formed a heap moves to the adjoining regions in the lengthwise direction of the sleeve 4 in a landslide fashion. Consequently, due to the automatic toner content control, the toner content of such a higher content portion is controlled to a further higher value, compared to the other portion. This aggravates the irregular toner content distribution and brings about irregular image density due to unstable development.

In light of the above, in the illustrative embodiment, the gap (developing gap) Gp between the surface of the sleeve 4 and that of the drum 1 is selected to be greater than the doctor gap Gd within a range which guarantees contact development based on a preselected developing ability. Such a developing gap Gp maintains the maximum packing ratio ($\rho 2$) of the developer on the sleeve 4, as measured at the developing position, smaller than or equal to the packing ratio ($\rho 1$) of the developer passing the doctor blade 6. In this condition, even when the higher toner content portion occurs due to some cause, the developer is prevented from remaining at the developing position. This obviates the problem discussed above and provides the developer in the chamber A and the developer being conveyed toward the developing position with a substantially uniform content in the lengthwise direction of the sleeve 4. Therefore, a desired developing condition can be stably maintained.

It is to be noted that the packing ratio $\rho$ is produced by:

$\rho(\%)=100\times$weight of packing substance$\div$(preselected volume$\times$true specific gravity of packing substance)

or $\rho(g/cm^3)=$weight of packing substance (g)/preselected volume ($cm^3$)

Assume that the developer on the sleeve 4 and just passed the doctor blade 6 has an amount M1 for a unit area, and that it has an amount M2 at the developing position (substantially identical with M1 if the developer does not remain at all). Then, the packing ratios $\rho 1$ and $\rho 2$ can be produced by $\rho 1=M1/Gd$ and $\rho 2=M2/Gd$, respectively. For example, assuming M1=0.05 $g/cm^2$ and Gd=0.03 cm, then $\rho 1$ is 1.7 $g/cm^3$. When M1 is 0.05 $g/cm^2$ and Gd=0.04 cm, $\rho 2$ is nearly equal to 1.25 $g/cm^3$.

Figure 10:
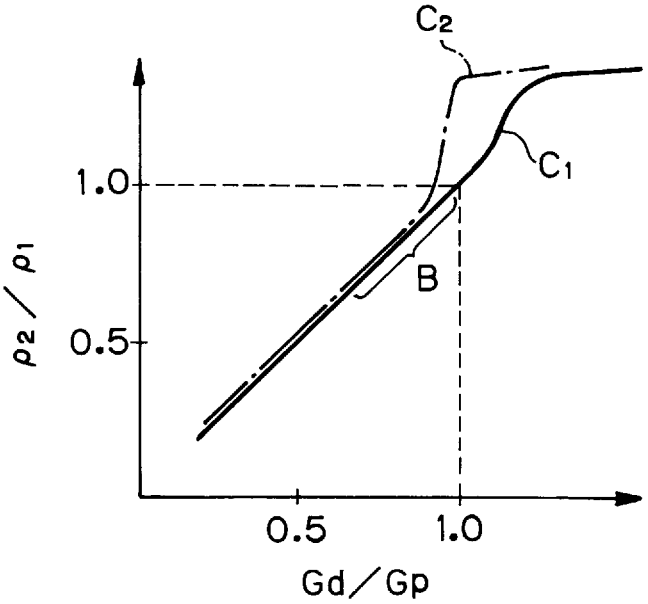
FIG. 10 is a graph showing a relation between a ratio in gap Gd/Gp and a ratio in packing ratio $\rho 2/\rho 1$ which will be described.

The developing gap Gp should preferably lie in a range of from 1.5 mm to 0.2 mm, more preferably in a range of from 0.6 mm to 0.2 mm. The doctor gap Gd should preferably lie in a range of from 0.7×Gp to 0.95×Gp. These ranges are labeled B in FIG. 10. In FIG. 10, curves C1 and C2 are respectively representative of a case wherein the toner content is normal and a case wherein it is high. The ratio of the linear velocity Vs of the sleeve 4 to the linear velocity Vp of the drum 1 is selected to lie in the range of $2\leqq Vs/Vp\leqq 5$.

With the above gaps, it is possible to surely maintain the maximum packing ratio $\rho 2$ ($\approx Gd/Gp\times\rho 1$) at the developing position lower than the packing ratio $\rho 1$ at the doctor blade 6. Therefore, there can be obviated an occurrence that the ratio $\rho 2/\rho 1$ sharply increases at and around the ratio Gd/Gp of 1, as shown in FIG. 10. When the ratio $\rho 2/\rho 1$ sharply increases, the developer remains at the developing position or sticks to the sleeve 4. Because the embodiment is free from such an occurrence, it obviates the shift of the developer in the lengthwise direction of the sleeve 4 and ascribable to the local remaining of the developer at the developing position. The locally remaining developer will causes the toner to be replenished in an excessive amount to the portions of the chamber A where the amount of carrier has decreased.

Figure 11A:
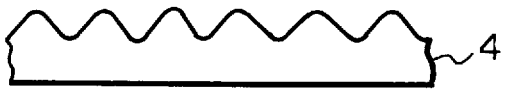
FIG. 11A is a section of a developing sleeve showing a modification of the second embodiment.
Figure 11B:
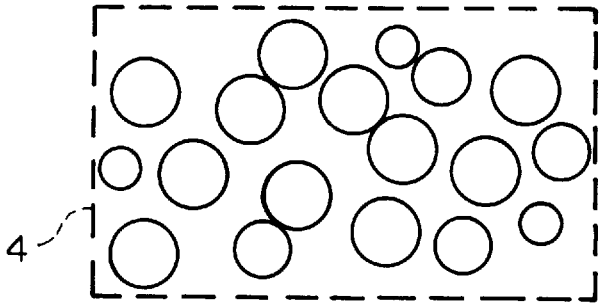
FIG. 11B is a plan view of the sleeve shown in FIG. 11A.
Figure 12A:
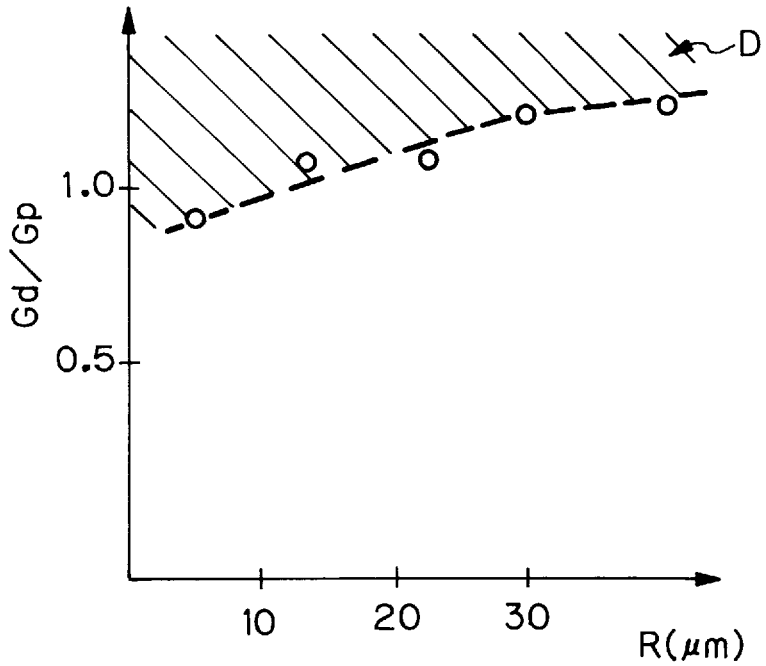
FIG. 12A is a graph showing a relation between the surface roughness R of the sleeve and the ratio Gd/Gp.
Figure 12B:
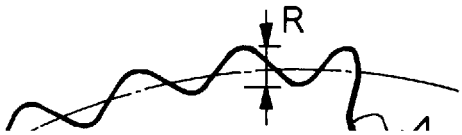
FIG. 12B shows the definition of the surface roughness R.

To prevent the developer from remaining at the developing position, the embodiment uses the developing gap Gp smaller than the doctor gap Gd. Alternatively, the conveying force of the sleeve 4 acting on the developer may be increased for the same purpose. Specifically, as shown in FIGS. 11A and 11B, the surface roughness of the sleeve 4 may be increased by, e.g., sand-blasting. FIG. 12A shows a relation between the surface roughness of the sleeve 4, defined by R in FIG. 12B, and the ratio Gd/Gp (Gp≈0.5 mm) causing the developer to remain at the developing position and to move in the lengthwise direction of the sleeve 4. In FIG. 12A, data with circles are representative of the lower limit of the ratio Gd/Gp bringing about the above undesirable occurrence, and such an occurrence is caused in a range D. As FIG. 12A indicates, by increasing the surface roughness and therefore the conveying force of the sleeve 4, it is possible to obviate the remaining of the developer at the developing position and the movement of the developer even if the ratio Gd/Gp is 1 or above.

Figure 13A:
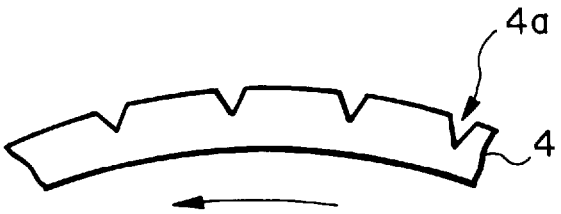
FIG. 13A is a section showing a developing sleeve included in another modification.
Figure 13B:
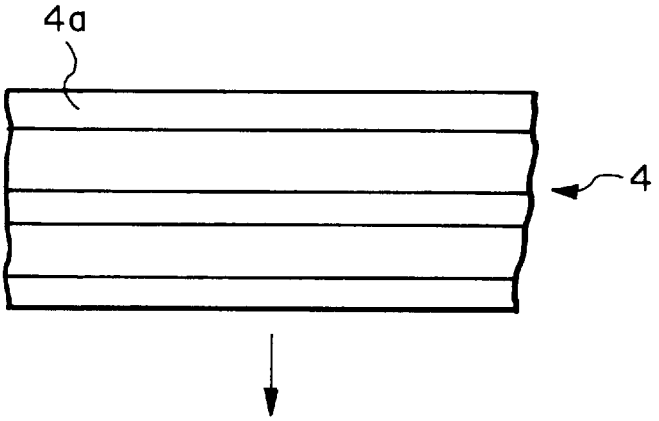
FIG. 13B is a plan view of the sleeve shown in FIG. 13A.

FIGS. 13A and 13B shows the sleeve 4 formed with grooves 4*a* in its lengthwise direction. The grooves 4*a* also increase the conveying force of the sleeve 4 rotatable in a direction indicated by an arrow.

Further, at least one of the device parameters having influence on the amount of the developer to pass through the developing position may be so set as to prevent the developer from remaining. A frictional force, inertial force (kinetic energy), magnetic force, Coulomb's force, gravity and collision force (repulsion) act on the developer passing through the developing position. As to the frictional force, the surface of the sleeve 4, the surface of the drum 1 and the developer consisting of toner and carrier form an interface. The frictional force is the sum of the vertical drag N of the interface and the coefficient of friction $\mu$. The major factors of the vertical drag N are the magnetic force, Coulomb's force ascribable to the amount of charge and developing potential, gravity, intermolecular force, etc. Considering the above forces acting on the developer, the device parameters include, in addition to the relation between the developing gap and the doctor gap and the surface configuration of the sleeve 4, the distribution of magnetic force exerted by the magnets of the sleeve 4 on the developer, the linear velocity of the sleeve 4, the relation in linear velocity between the sleeve 4 and the drum 1, the difference in potential between the latent image on the drum 1 and the sleeve 4, and the characteristic of the developer.

Specific device parameters determined by experiments are as follows. As for the magnetic force, assume that use is made of a developer containing magnetic toner and having a magnetization ratio of 50 emu/g to 80 emu/g for a magnetic field strength of 3 kOe, as in the embodiment. Then, the flux density (component in the direction of a normal on the sleeve surface) ascribable to the main pole for development should preferably be between 60 mT and 100 mT while the angle of the main pole (upstream side or positive side in the direction of developer conveyance) should preferably be between 3 degrees and 12 degrees. As for the linear velocities, when the drum 1 and sleeve 4 each rotates at a linear velocity between 50 mm/sec and 300 mm/sec, the ratio of the linear velocity Vd of the sleeve 4 to the linear velocity Vp of the drum 1 should preferably be 1.5 to 3.5. As for the potential of the latent image and that of the sleeve 4, when the drum 1 is charged to the same polarity as the toner, i.e., the positive polarity, the difference between the potential of the non-image area and background of the drum 1 and that of the sleeve 4 should preferably range from 50 V to 200 V. The maximum difference between the potential of the image portion of highest density on the drum 1 and that of the sleeve 4 is preferably less than 600 V. As for the characteristic of the developer, when use is made of the magnetic toner, the preferable range of magnetization ratio of the developer is 50 emu/g to 80 emu/g for a magnetic field strength of 3 kOe; the electric resistance of the carrier (powder) is preferably between 106 Ωcm and 109 Ωcm. To measure the electric resistance of the carrier, while a developing sleeve with a diameter of 30 mm was rotated at a speed of 600 rpm with only the carrier deposited thereon, a voltage-to-current characteristic between the sleeve and a doctor blade was measured. The doctor gap was selected to be 1 mm while the edge of the doctor blade facing the sleeve had an area of 1 mm×100 mm.

Furthermore, to prevent the developer from remaining at the developing position, the device parameters may be such that the developer passed through the doctor gap in a given period of time passes through the developing position in the same period of time. In this case, in order that the developer conveyed to the developing position for a unit period of time may entirely pass through the developing position in the same period of time, it is necessary that even when the resultant of the forces acting on the developer at the developing position becomes minimum as a conveying force, the resultant does not act in the direction in which the developer flows in the reverse direction and remains. Specific device parameters satisfying the above requirement are (1) the developing gap greater than the doctor gap, (2) the difference in linear velocity between the drum 1 and the sleeve 4 small enough to prevent the drum 1 from obstructing the conveyance, (3) the bias voltage for development low enough to prevent the Coulomb's force from acting between the carrier and the drum 1 easily, (4) the linear velocity of the sleeve 4 high enough to enhance the inertial force of the developer, and (5) the magnetic force acting on the developer and intense enough for the developer to be intensely attracted toward the sleeve 4. Further, the surface of the sleeve 4 may be formed with holes by sand-blasting or with grooves by knurling. In such a case, it is preferable to increase the depth and the ratio of the recesses of the sleeve 4.

The increase in the depth and the ratio of the recesses allows more than 90% of the developer to be caught by the recesses and conveyed via the developing position at the same speed as the surface of the sleeve 4. Even the other developer can be smoothly conveyed via the developing position by being entrained by the developer caught by the recesses. Among the device parameters described above, the relation between the developing gap and the doctor gap, the surface configuration of the sleeve 4, the magnetic force of the magnet acting on the developer and the arrangement of magnetic poles have noticeable influence on the amount in which the developer is conveyed via the developing position.

Figure 14A:
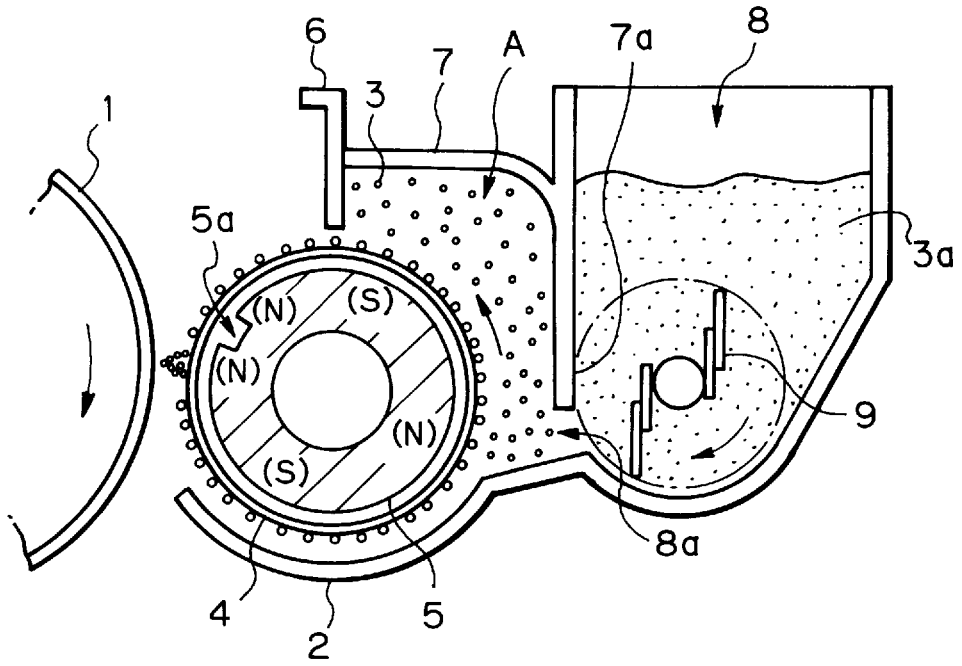
FIG. 14A is a section showing another modification.
Figure 14B:
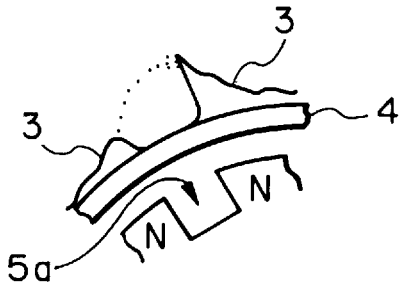
FIG. 14B is an enlarged view of a developing position included in the modification shown in FIG. 14A.

The embodiment prevents the developer from remaining at the developing position, as stated above. In addition, to prevent an irregular toner content distribution occurred in the lengthwise direction from being aggravated, magnetic field generating means may be provided such that the developer 3 is spaced from the surface of the sleeve 4 at a position upstream of the developing position in the direction of rotation of the sleeve 4. As shown in FIGS. 14A and 14B, the magnetic field generating means may be implemented as a groove 5*a* formed in the magnet roller 5. The groove 5*a* is located in a portion of the roller 5 upstream of the developing position and where a magnetic pole (N pole) is formed. A magnetic field for causing the developer to move away from the sleeve 4 is formed at the position of the sleeve 4 facing the groove 5*a*. As a result, as shown in FIG. 14B, the developer 3 once floats away from the sleeve 4 and again deposits on the sleeve 4. In this manner, the developer is caused to slightly remain at the position upstream of the groove 5*a*. When the amount of the developer or the toner content is irregular, the developer remaining at the above position moves in the lengthwise direction of the sleeve 4 only to a degree sufficient to reduce the irregularity.

Figure 15:
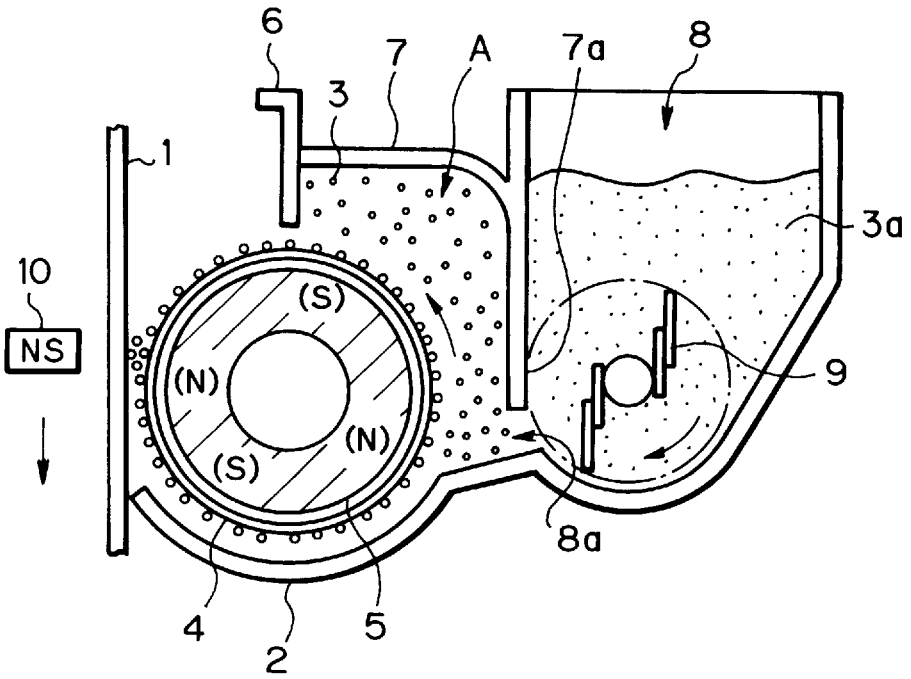
FIG. 15 is a section showing still another modification.

Alternatively, as shown in FIG. 15, the groove 5*a* may be replaced with a magnet 10. In this case, a photoconductive belt is substituted for the drum 1. The magnet 10 is located at the rear of the belt 1. If desired, the magnet 10 may be replaced with a magnetic body.

In the illustrative embodiment, as the ratio $\rho 2/\rho 1$ decreases, there decreases the developing ability, i.e., the degree of deposition of the toner on the drum for a preselected electric field formed between the drum 1 and the sleeve 4. In light of this, it is preferable to maintain the ratio ρ2/ρ1 above 0.8 inclusive. However, if the ratio ρ2/ρ1 is about 0.9 and if the accuracy of the sleeve 4 and that of the developing gap Gp are short, the developer temporarily and locally remains at the developing position with the result that the carrier in the corresponding portion of the chamber A decreases. Consequently, the toner is replenished in an excessive amount and results in the unusual increase of toner content. In addition, in the event of development, such an amount of toner locally contaminates the background of an image. It is therefore preferable that the ratio ρ2/ρ1 be so selected as to provide a preselected developing ability at the time of image formation, but reduced at the time when image formation is not effected.

To reduce the ratio ρ2/ρ1, a solenoid or a cam may controlled by a controller, not shown, in such a manner as to increase the developing gap Gp while image formation is not effected. Then, the magnet brush and drum 1 scarcely contact each other at the developing position or lightly contacts each other. As a result, the irregular toner content occurred at the time of image formation in the lengthwise direction of the sleeve 4 can be reduced by a uniform stress exerted by the doctor blade 6, as determined by experiments. Alternatively, the doctor blade 6 may be moved by a solenoid or a cam when image formation is not effected. Further, a subdoctor blade independent of the doctor blade 6 may be used and moved to vary the doctor gap Gd.

Moreover, to reduce the irregular toner content and prevent the developer from remaining at the developing position, a power source, not shown, may be controlled by a controller, not shown, such that a greater potential difference is set up between the doctor blade 6 and the sleeve when image formation is not effected than when it is effected. As for an AC voltage, 500 V peak-to-peak or above is desirable. As for a DC voltage, it is preferable that the doctor blade 7 has a charge polarity opposite to that of the carrier, and that the absolute value of the voltage is 500 V or above. During image formation, the potential difference between the doctor blade 6 and the sleeve 4 should preferably be small; the smaller the potential difference, the greater and more stable the amount of the developer capable of moving away from the doctor blade 6 is.

In addition, a driver for driving the sleeve 4 may be so controlled as to increase the peripheral speed Vs of the sleeve 4 for a moment during image formation. This also successfully reduces the irregular toner content and prevents the developer from remaining at the developing position. For the same purpose, the other device parameters having influence on the amount of the developer to pass through the developing position may be controlled such that the developer passes through the above position in a greater amount when image formation is not effected.

In the embodiment, the toner is introduced into the developer on the basis of the volume of the developer in the chamber A which varies with the varying toner content, so that the toner content is automatically controlled, as stated earlier. If desired, the volume of the developer in the chamber A may be replaced with the weight or the carrier density of the developer in the chamber A which also varies with the varying toner content. This also stably maintains the desired developing condition.

The control over the introduction of the toner into the developer may alternatively be based on the fact that the volume of the developer regulated by the developer regulating member varies with the varying toner content of the developer. In this case, a developer having a preselected toner content is set in a predetermined amount in the developing device and then distributed on the sleeve 4 so as to determine how it remains at the developing position. An arrangement is made such that the condition wherein the developer remains at the above position coincides with an average condition wherein the developer remains at the same position when the toner content of the developer varies within the target range due to repeated image formation. This also stably maintains the desired developing condition.

The magnetic toner may, of course, be replaced with nonmagnetic toner. Use is made of nonmagnetic toner having a true specific gravity of 1.2 g/cm$^3$ and a volumetric mean particle size of 7.5 μm to 9.0 μm. This kind of toner is generally combined with carrier having a true specific gravity of 5.2 g/cm$^3$ and a volumetric mean particle size of 60 μm to 70 μm. Assume that such a toner and carrier mixture is used, and that the carrier covering ratio is 50%, considering the characteristic of the nonmagnetic toner. Then, the toner content of the mixture is 5 wt % to 10 wt %. It follows that the target toner content for the automatic control is generally 2 wt % to 10 wt %.

As stated above, the second embodiment has various advantages, as enumerated below.

(1) Even when the toner content of the developer deposited on a developer carrier accidentally becomes irregular in the direction perpendicular to the direction of conveyance before reaching a developing position, the developer is prevented from remaining at the developing position. This stably maintains a desired developing condition.

(2) Even when the toner content of the developer becomes irregular, as stated above, the maximum packing ratio (ρ2) of the developer on the developer carrier, as measured at the developing position, is lower than or equal to the packing ratio (ρ1) of the developer passing a developer regulating member. This prevents the developer from remaining at the developing position and thereby stably maintains a desired developing condition.

(3) Even when the toner content of the developer becomes irregular, as stated above, the developer moved away from a gap between the developer carrier and the developer regulating member passes through a gap between the developer carrier and an image carrier and which is greater than the above gap. This prevents the developer from remaining at the developing position and thereby stably maintains a desired developing condition.

(4) Even when the toner content of the developer is locally increased at the developing position in the direction perpendicular to the direction of conveyance, the packing ratio (ρ2) of the developer with the increased toner content is lower than the packing ratio (ρ1) of the developer passing the developer regulating member. This prevents the above portion of the developer from remaining at the developing position. Therefore, at the portion where the toner content is maximum, the toner content is prevented from being controlled to a further higher value due to the remaining developer.

(5) Even when the toner content of the developer deposited on the developer carrier accidentally becomes irregular in the direction perpendicular to the direction of conveyance before reaching a developing position, the same amount of developer for a unit area, except for toner to be consumed at the developing position, exists on the developer carrier at a position adjoining, but downstream of, the developer regulating member, a position adjoining, but upstream of, a position closest to the image carrier, and the position closest to the image carrier. This prevents the developer from remaining at the developing position and thereby stably maintains a desired developing condition.

(6) Device parameters having influence on the amount of the developer to pass through the developing position are adequately set. Therefore, even when the toner content of the developer becomes irregular, as stated above, the developer on the developer carrier and moved away from the gap between the developer carrier and the developer regulating member is prevented from remaining at the developing position. This stably maintains a desired developing condition.

(7) The developer on the developer carrier passes through the gap between the developer carrier and the developer regulating member and the gap between the developer carrier and the image carrier in the same period of time. Therefore, even when the toner content of the developer becomes irregular, as stated above, the developer on the developer carrier is prevented from remaining at the developing position. This stably maintains a desired developing condition.

(8) At least one of the device parameters having noticeable influence on the above amount of the developer is adequately set. Hence, even when the toner content of the developer becomes irregular, as stated above, the developer on the developer carrier is more surely prevented from remaining at the developing position. This further stably maintains a desired developing condition.

(9) Even when the toner content of the developer becomes irregular during ordinary control of the toner content to a target range, the developer on the developer carrier does not remain at the developing position. This stably maintains a desired developing condition.

(10) The average condition wherein the developer remains at the developing position is identical with the adequate condition wherein a developer having a preselected toner content and set in the device in a preselected amount is distributed on the developer carrier. Therefore, even when the toner content of the developer on the developer carrier becomes irregular before reaching the developing position, the developer is prevented from remaining at the developing position. This stably maintains a desired developing condition.

(11) The developer is caused to slightly remain in a stable manner at a position adjoining, but upstream of, the developing position. As a result, the developer is caused to move in the direction perpendicular to the direction of conveyance in such a manner as to reduce irregular toner content and irregular developer distribution in the above direction. Therefore, even when the toner content of the developer on the developer carrier becomes irregular in the above direction, the developer is prevented from remaining at the developing position; otherwise, irregular image density would occur.

(12) The ratio of the packing ratio ($\rho 2$) of the developer on the developer carrier at the developing position to the packing ratio ($\rho 1$) of the same at the developer regulating member is smaller when image formation is not effected than when it is effected. Therefore, even when the toner content of the developer on the developer carrier becomes irregular, as stated above, the developer remaining at the developing position is driven away when the image formation is not effected. As a result the irregular toner content is reduced. This obviates the remaining of the developer at the developing position and causative of irregular image density while preserving the developing ability for image formation.

(13) The developer is caused to pass through the developing position in a greater amount when image formation is not effected than when it is effected. This also achieves the above advantage (12).

(14) The gap between the surface of the developer carrier and that of the image carrier is broader when image formation is not effected than when it is effected. As a result, the ratio $\rho 2/\rho 1$ is smaller when image formation is not effected than when it is effected, also driving away the developer remaining at the developing station.

(15) The gap between the surface of the developer carrier and the edge of the developer regulating member is smaller when image formation is not effected than when it is effected. This also achieves the above advantage (14).

(16) The difference in potential between the developer carrier and the developer regulating member is greater when image formation is not effected than when it is effected. Therefore, even when the toner content of the developer on the developer carrier becomes irregular and causes the developer to remain at the developing position, the amount of the developer to pass through the gap between the image carrier and the regulating member is reduced. As a result, the irregular toner content is reduced. This obviates the remaining of the developer while preserving the developing ability for image formation.

(17) The surface of the developer carrier moves at a higher speed when image formation is not effected than when it is effected. This also achieves the above advantage (16).

(18) The replenishment of toner into the developer is effected by automatic toner content control in accordance with the weight, volume or carrier density of the developer received in the chamber. At this instant, even when the toner content of the developer on the developer carrier becomes irregular, the developer does not remain at the developing position. This prevents the irregular toner content from being aggravated and stably maintains a desired developing condition.

(19) The developer is circulated in the chamber. Therefore, the developer in the chamber and the developer being conveyed along the surface of the developer carrier are evenly used for development. This extends the service life of the developer even when the amount of developer to be set is reduced to meet the need for a miniature configuration.

(20) Even when the toner content of the developer on the developer carrier sharply decreases, it can be rapidly restored because toner is replenished even from the developer being circulated in the chamber in contact with the developer deposited on the developer carrier. Therefore; even if the amount of developer is reduced to meet the need for a miniature configuration, the device implements a high-speed image forming apparatus.

(21) Assume that the replenishment of toner into the developer varies in accordance with the amount of carrier existing in the chamber, causing the toner content of the developer on the developer carrier to vary. Then, even when the toner content of the developer on the developer carrier becomes irregular, the developer does not remain at the developing position. This prevents the irregular toner content from being aggravated and stably maintains a desired developing condition.

Various modifications will become possible for those skilled in the art after receiving the teachings of the present disclosure without departing from the scope thereof.

What is claimed is:

1. A developing device for an image forming apparatus and for developing a latent image electrostatically formed on an image carrier by conveying a developer to a developing position where said device faces said image carrier, said device comprising:

a chamber for receiving a two-ingredient type developer consisting of toner and magnetic particles;

a developer carrier having magnetic field generating means disposed thereinside, for conveying the developer to the developing position by magnetically retaining the developer;

a developer regulating member for regulating an amount of the developer deposited on said developer carrier by causing the developer to pass through a gap between said developer regulating member and said developer carrier;

a toner storing section storing toner to be replenished into the developer, and communicated to said chamber via an opening; and replenishment regulating means for causing the toner to be introduced into said chamber in a smaller amount at portions adjoining opposite ends of said developer carrier in a widthwise direction of said developer carrier than at an intermediate portion of said developer carrier.

2. A device as claimed in claim 1, wherein said chamber is formed in a developer container comprising an opening for communicating said chamber to a body of said device accommodating said developer carrier, and a removable shutter member closing said opening, and wherein said developer container is removably mounted to said body.

3. A device as claimed in claim 1, wherein said magnetic field generating means extends in a lengthwise direction of said developer carrier over a length Lm, wherein said opening has a length Wt in the widthwise direction of said developer carrier, and wherein said replenishment regulating means comprises said opening configured such that the length Wt is smaller than the length Lm, and such that opposite end portions of said opening in the widthwise direction of said developer carrier are positioned closer to a center than opposite end portions of said magnetic field generating means.

4. A device as claimed in claim 1, wherein said opening has a dimension smaller than a width of said chamber.

5. A device as claimed in claim 1, wherein said opening extends in a widthwise direction of said chamber, wherein a toner conveying member conveys the toner toward said chamber via said opening, and wherein said replenishment regulating means is configured such that an ability of said toner conveying member to convey the toner is lower at portions adjoining opposite ends of said opening than at an intermediate portion of said opening.

6. A device as claimed in claim 5, wherein said toner conveying member comprises a shaft parallel to said opening, and a toner driving member affixed to said shaft and rotatable about said shaft, and wherein said toner conveying member is configured such that a maximum circular locus which said toner driving member forms while in rotation is smaller at said portions adjoining said opposite ends than at said intermediate portion.

7. A developing device comprising:

a developer carrier for conveying a developer consisting of toner and carrier to a developing position where said developer carrier faces an image carrier; and a chamber adjoining said developer carrier, for receiving the developer therein;

wherein said device develops a latent image electrostatically formed on the image carrier by holding the developer in contact with a surface of said image carrier, and replenishing toner into the developer deposited on said developer carrier on the basis of a movement of the developer caused by conveyance of the developer; and wherein the developer deposited on said image carrier is so controlled as not to remain at the developing position.

8. A device as claimed in claim 7, further comprising a developer regulating member for regulating an amount of the developer to be conveyed by said developer carrier to the developing position, and wherein a maximum packing ratio ($\rho 2$) of the developer on said developer carrier at the developing position is smaller than or equal to a packing ratio ($\rho 1$) of the developer passing said developer regulating member.

9. A device as claimed in claim 8, wherein a gap formed at the developing position between a surface of said developer carrier and a surface of said image carrier is greater than a gap between the surface of said developer carrier and an edge of said developer regulating member.

10. A device as claimed in claim 7, further comprising a developer regulating member for regulating an amount of the developer to be conveyed by said developer carrier to the developing position, and wherein at the developing position a portion having a maximum toner content in a direction perpendicular to an intended direction of developer conveyance has a packing ratio ($\rho 2$) smaller than or equal to a packing ratio ($\rho 1$) of the developer passing said developer regulating member.

11. A device as claimed in claim 7, further comprising a developer regulating member for regulating an amount of the developer to be conveyed by said developer carrier to the developing position, wherein an amount of the developer for a unit area deposited on a first portion of said developer carrier closest to the surface of said image carrier, an amount of the developer for a unit area deposited on a second portion of said developer carrier adjoining said first portion at an upstream side in an intended direction of developer conveyance, and an amount of the developer for a unit area deposited on a third portion of said developer carrier adjoining said first portion at a downstream side in said direction are identical except for the toner consumed at the developing position.

12. A device as claimed in claim 7, further comprising a developer regulating member for regulating an amount of the developer to be conveyed by said developer carrier to the developing position, wherein a device parameter having influence on an amount of the developer to pass through the developing position is so set as to prevent the developer moved away from a gap between said developer carrier and said developer regulating member from remaining at the developing position.

13. A device as claimed in claim 7, further comprising a developer regulating member for regulating an amount of the developer to be conveyed by said developer carrier to the developing position, wherein a device parameter having influence on an amount of the developer to pass through the developing position is so selected as to cause the developer passed through a gap between said developer carrier and said developer regulating member in a preselected period of time to pass through the developing position in said preselected period of time.

14. A device as claimed in claim 13, wherein the device parameter comprises at least one of a relation between said gap between said developer carrier and said developer regulating member and a gap between said developer carrier and the image carrier, a surface configuration of said developer carrier, a distribution of magnetic force which a magnet disposed in said developer carrier exerts on the developer, a linear velocity of said developer carrier, a relation between the linear velocity of said developer carrier and a linear velocity of the image carrier, a difference in potential between the latent image and said developer carrier, and a characteristic of the developer.

15. A device as claimed in claim 7, wherein the developer is prevented from remaining when a toner content of the developer lies in a target range.

16. A developing device comprising:

a developer carrier for conveying a developer consisting of toner and carrier to a developing position where said developer carrier faces an image carrier; and a developer regulating member for regulating an amount of the developer to be conveyed by said developer carrier to the developing position;

wherein said device develops a latent image electrostatically formed on the image carrier by holding the developer deposited on said developer carrier in contact with a surface of the image carrier, and controls, based on a fact that a volume of the developer shaved off by said developer regulating member varies with a varying toner content of the developer, replenishment of toner into the developer; and wherein the developer deposited on said developer carrier is so controlled as not to remain at the developing position.

17. A device as claimed in claim 16, wherein a maximum packing ratio ($\rho 2$) of the developer on said developer carrier at the developing position is smaller than or equal to a packing ratio ($\rho 2$) of the developer passing said developer regulating member.

18. A device as claimed in claim 16, wherein an amount of the developer for a unit area deposited on a first portion of said developer carrier closest to the surface of said image carrier, an amount of the developer for a unit area deposited on a second portion of said developer carrier adjoining said first portion at an upstream side in an intended direction of developer conveyance, and an amount of the developer for a unit area deposited on a third portion of said developer carrier adjoining said first portion at a downstream side in said direction are identical except for the toner consumed at the developing position.

19. A device as claimed in claim 16, wherein a device parameter having influence on an amount of the developer to pass through the developing position is so selected as to prevent the developer passed through a gap between said developer carrier and said developer regulating member from remaining at the developing position.

20. A developing device comprising:

a developer carrier for conveying a developer consisting of toner and carrier to a developing position where said developer carrier faces an image carrier; and a developer regulating member for regulating an amount of the developer to be conveyed by said developer carrier to the developing position;

wherein said device develops a latent image electrostatically formed on the image carrier by holding the developer deposited on said developer carrier in contact with a surface of the image carrier, and controls, based on a fact that a volume of the developer shaved off by said developer regulating member varies with a varying toner content of the developer, replenishment of toner into the developer; and wherein a condition wherein the developer remains at the developing position when a developer having a preselected toner content is set in a preselected amount in said device and distributed on said developer carrier is identical with an average condition wherein the developer remains at the developing position when a toner content of the developer varies within a target range due to repeated image forming operation.

21. A developing device comprising:

a developer carrier for conveying a developer consisting of toner and carrier to a developing position where said developer carrier faces an image carrier; and a chamber adjoining said developer carrier, for receiving the developer therein, wherein said device develops a latent image electrostatically formed on the image carrier by holding the developer in contact with a surface of said image carrier, and replenishing toner into the developer deposited on said developer carrier on the basis of a movement of the developer caused by conveyance of the developer; and magnetic field generating means for generating, at a positioning adjoining the developing position at an upstream side of the developing position in an intended direction developer conveyance, a magnetic field for spacing the developer from a surface of said developer carrier.

22. A developing device comprising:

a developer carrier for conveying a developer consisting of toner and carrier to a developing position where said developer carrier faces an image carrier;

a chamber adjoining said developer carrier, for receiving the developer therein; and a developer regulating member for regulating an amount of the developer to be conveyed by said developer carrier to the developing position;

wherein said device develops a latent image electrostatically formed on the image carrier by holding the developer in contact with a surface of said image carrier, and replenishing toner into the developer deposited on said developer carrier on the basis of a movement of the developer caused by conveyance of the developer; and wherein a device parameter having influence on a packing ratio ($\rho 1$) of the developer passing said developer regulating member and a packing ratio ($\rho 2$) of the developer deposited on said developer carrier at the developing position is switched such that a ratio $\rho 2/\rho 1$ is smaller when image formation is not effected than when image formation is effected.

23. A developing device comprising:

a developer carrier for conveying a developer consisting of toner and carrier to a developing position where said developer carrier faces an image carrier;

a chamber adjoining said developer carrier, for receiving the developer therein; and a developer regulating member for regulating an amount of the developer to be conveyed by said developer carrier to the developing position;

wherein said device develops a latent image electrostatically formed on the image carrier by holding the developer in contact with a surface of said image carrier, and replenishing toner into the developer deposited on said developer carrier on the basis of a movement of the developer caused by conveyance of the developer; and wherein a device parameter having influence on an amount of the developer passing through the developing position is switched such that the amount of the developer passing through said developing position is greater when image formation is not effected than when image formation is effected.

24. A device as claimed in claim 23, further comprising:

gap switching means for switching a size of a gap between a surface of said developer carrier and a surface of the image carrier; and control means for controlling said gap switching means such that said gap increases when image formation is not effected.

25. A device as claimed in claim 23, further comprising:

gap switching means for switching a size of a gap between a surface of said developer carrier and an edge of said developer regulating member; and control means for controlling said gap switching means such that said gap decreases when image formation is not effected.

26. A device as claimed in claim 23, further comprising:

potential difference producing means for producing a difference in potential between said developer carrier and said developer regulating member; and control means for controlling said potential difference producing means such that the difference increases when image formation is not effected.

27. A device as claimed in claim 23, further comprising:

drive means for driving said developer carrier to thereby convey the developer deposited on said developer carrier to the developing position; and control means for controlling said drive means such that said developer carrier rotates at a higher speed when image formation is not effected than when image formation is effected.

28. A device as claimed in claim 23, wherein one of a weight, a volume and a carrier density of the developer received in said chamber varies with a varying toner content of the developer, and wherein toner is replenished into the developer deposited on said developer carrier in accordance with a variation of one of the weight, volume, and carrier density.

29. A device as claimed in claim 28, wherein the developer is circulated in said chamber, and wherein the toner is replenished into the developer at a point where the developer being circulated in said chamber and the developer being conveyed along a surface of said developer carrier join each other.

30. A device as claimed in claim 23, wherein an amount of replenishment of toner into the developer varies with a variation in an amount of the developer carrier received in said chamber, thereby varying the toner content of the developer deposited on said developer carrier.

* * * * *